US005210782A

United States Patent [19]

Geluk et al.

[11] Patent Number: 5,210,782

[45] Date of Patent: May 11, 1993

[54] METHOD AND APPARATUS FOR SPLIT RADIOGRAPHY

[75] Inventors: Ronald J. Geluk, Nootdorp; Hugo Vlasbloem, Maasland, both of Netherlands

[73] Assignee: B.V. Optische Industrie "De Oude Delft", Delft, Netherlands

[21] Appl. No.: 752,636

[22] PCT Filed: Feb. 26, 1990

[86] PCT No.: PCT/EP90/00338

§ 371 Date: Aug. 28, 1991

§ 102(e) Date: Aug. 28, 1991

[87] PCT Pub. No.: WO90/10939

PCT Pub. Date: Sep. 20, 1990

[30] Foreign Application Priority Data

Mar. 7, 1989 [NL] Netherlands ..... 8900553

[51] Int. Cl.[5] ..... G21K 5/10

[52] U.S. Cl. ..... 378/146; 378/145; 378/151

[58] Field of Search ..... 378/145, 146, 147, 149, 378/150, 151, 152, 153, 156, 157, 158, 160

[56] References Cited

U.S. PATENT DOCUMENTS

| | | | |
|---|---|---|---|
| 4,677,652 | 6/1987 | Duinker et al. | 378/146 |
| 4,785,471 | 11/1988 | Boersma | 378/146 |
| 4,996,701 | 2/1991 | Geluk | 378/146 |

FOREIGN PATENT DOCUMENTS

| | | |
|---|---|---|
| 3517460 | 11/1986 | Fed. Rep. of Germany . |
| 3901655 | 8/1989 | Fed. Rep. of Germany . |
| 2635035 | 2/1990 | France . |

*Primary Examiner*—David P. Porta
*Attorney, Agent, or Firm*—Louis E. Marn

[57] ABSTRACT

In an equalization radiography device an X-ray fan beam (3,4) is used to scan a body (7) under examination. The X-ray fan beam comprises a number of adjacent sectors. A modulator device (5) comprising a number of controllable beam sector modulators is present for controlling per sector the quantity of X-ray radiation transmitted. A detector (11) placed behind the body generates per sector a measurement signal representing a desired position of the beam sector modulator for that sector. During operation the instantaneous position of each beam sector modulator is continuously detected (20,21). Signals representing those positions are generated and compared with the respective measurement signals. Control signals are derived from the comparisons to control the positions of the respective beam sector modulators.

18 Claims, 2 Drawing Sheets

METHOD AND APPARATUS FOR SPLIT RADIOGRAPHY

The invention relates to a method for slit radiography, in which, with the aid of an X-ray source and a slit-type diaphragm placed in front of the X-ray source, a fan-type X-ray beam is formed, with which beam a body under examination is scanned at least partially in a direction transverse to the longitudinal direction of the slit of the slit-type diaphragm in order to form an X-ray shadow image on an X-ray detector placed behind the body, which fan-type X-ray beam is formed by a multiplicity of sectors situated adjacently to one another, the transmitted X-ray radiation being influenced instantaneously during the scanning movement per sector of the fan-type beam, while in operation, by means of controllable beam sector modulators interacting with the slit diaphragm, the quantity of radiation transmitted through the body being measured with the aid of detection means instantaneously per sector of the X-ray beam during the scanning movement and the measurement result being used to control the beam sector modulators. The invention furthermore relates to an apparatus for applying the method.

Such a method and such an apparatus are known from the Dutch Patent Application 84.00845. According to the technique known from the Dutch Patent Application 84.00845, to regulate the quantity of x-ray radiation transmitted through the slit diaphragm at any instant in time, use is made of attenuating devices which are placed near or in the slit of the slit diaphragm and act as beam sector modulators, which can each influence a sector of the fan-type X-ray beam and which, depending on the attenuation occurring in the associated sector and caused by the body under examination, are controlled in a manner such that the attenuating devices extend to a greater or lesser degree into the X-ray beam. If the attenuation due to the transradiated body is large in a particular sector at a particular instant, the attenuation device. associated with the sector is moved completely or largely out of the X-ray beam. On the other hand, if the attenuation due to the body is low in a particular sector at a particular instant, the associated attenuation device is brought further into the X-ray beam.

The advantage of this technique is that equalized radiographs can thereby be obtained, that is to say, radiographs which have a good contrast both in the light parts and in the dark parts. Therefore if, for example, a radiograph is made in this manner of the upper part of the body of a patient, the radiologist is able to find, in one and the same radiograph, adequate information for both the chest and the abdominal cavity of the patient, whereas two different radiographs were hitherto necessary to obtain the same information.

One problem in the known method is that the beam sector modulators may exhibit hysteresis phenomena. These phenomena occur, in particular, if piezoelectric tongues are used as (carriers of) absorption devices, but also, for example, in the case of beam sector modulators which comprise spring devices or are linked thereto.

As a consequence of such hysteresis phenomena, for example, the position of a beam sector modulator with respect to the beam sector to be influenced may deviate from the position which corresponds to the signals provided by the detection means. Undesirable artefacts may consequently be produced in the final X-ray shadow image.

The object of the invention is to eliminate, or at least to reduce, the problem outlined.

For this purpose, according to the invention, a method of the type described is characterized in that, during operation, the instantaneous position of each beam sector modulator is continuously detected, in that an electrical signal representing the instantaneous position is generated for each beam sector modulator, in that the electrical signal representing the instantaneous position is compared with the measurement result provided by the detection means and associated with the respective beam sector, and in that a control signal for the respective beam sector modulator is formed from the measurement result and the signal representing the instantaneous position.

A slit radiography apparatus comprising an X-ray source which is able to scan, at least partially, via a slit or a slit diaphragm a body under examination with a fan-type beam in a direction transverse to the longitudinal direction of the slit in order to form an X-ray shadow image on an X-ray detector, beam sector modulators interacting with the slit diaphragm which, during operation, are able to influence the fan-type beam instantaneously per sector during the scanning movement in order to be able to regulate the X-ray radiation incident in each sector on the body under examination, and detection means which are designed to detect, during a scanning movement of the X-ray beam, the quantity of X-ray radiation transmitted through the body instantaneously per sector and to convert it into corresponding signals, is characterized, according to the invention, by means which, during operation, are able to detect the instantaneous position of each beam sector modulator and are able to provide electrical signals corresponding to the detected positions, and by means which are able to form control signals for the beam sector modulators from the said electrical signals and the signals provided by the detection means for the quantity of radiation transmitted through a body.

The invention will be described in more detail below with reference to the accompanying drawing.

Figure 3:
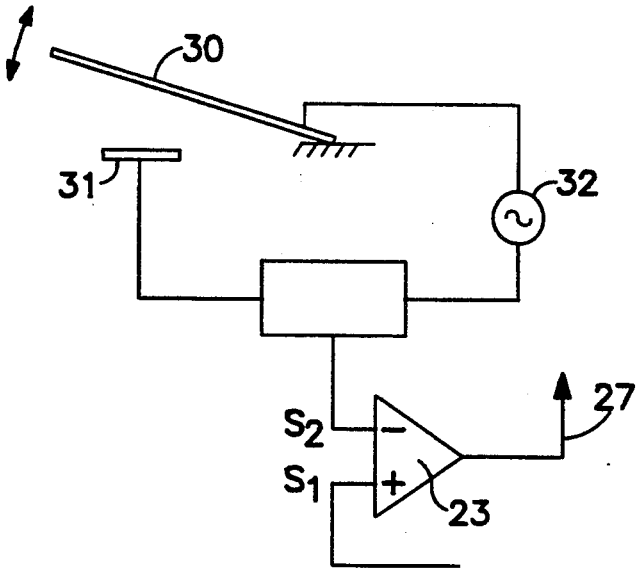
FIG. 3 shows diagrammatically a variant of a part of FIG. 2.
Figure 4:
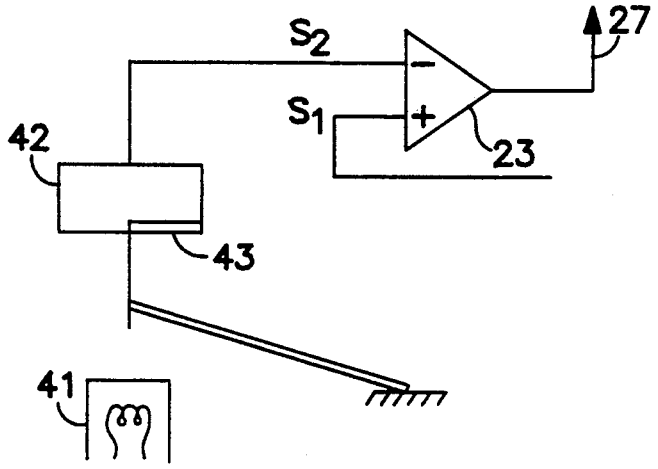

FIG. 4 further shows diagrammatically a variant of a part of FIG. 3.

Figure 5:
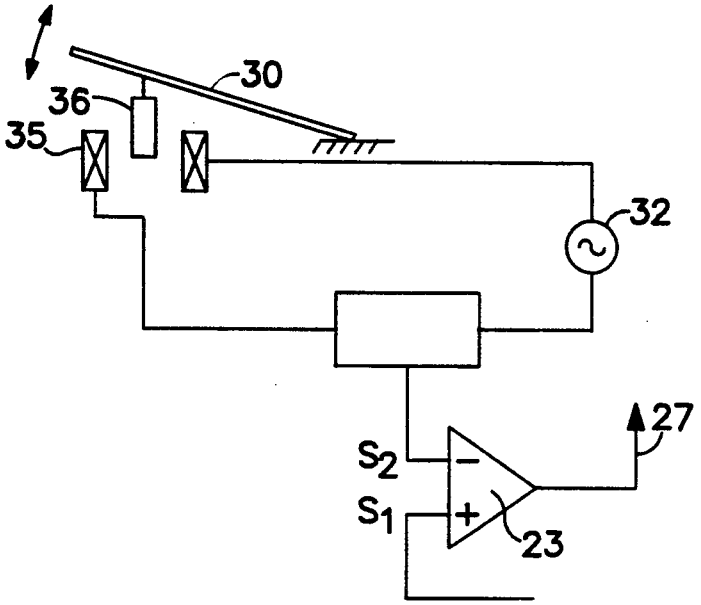

FIG. 5 shows diagrammatically a variant of FIG. 3.

Figure 1:
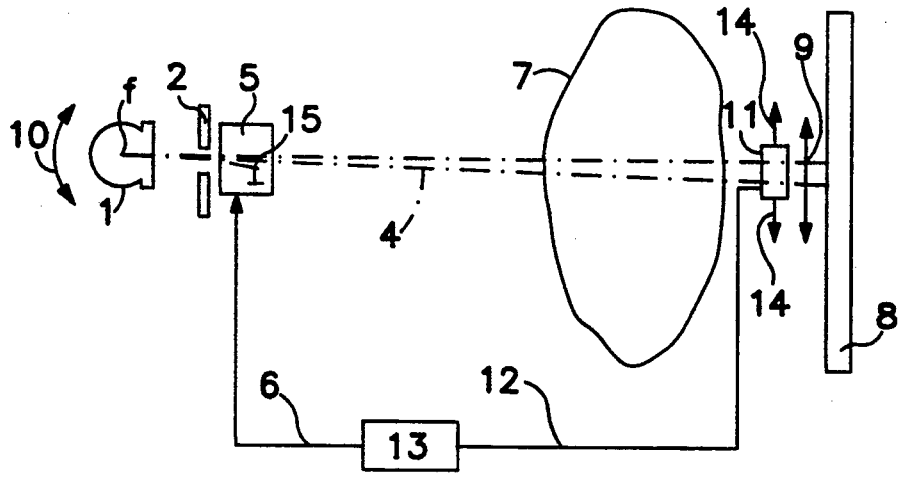
FIG. 1 (PRIOR ART)
FIG. 1 shows diagrammatically an example of a known slit radiography apparatus.

FIG. 1 shows diagrammatically an example of a known slit radiography apparatus. The slit radiography apparatus shown comprises an X-ray source 1 having an X-ray focus f. Placed in front of the X-ray source is a slit diaphragm 2 having a slit 3 which, during operation, transmits an essentially flat, fan-type X-ray beam 4. A beam sector modulation system 5 is furthermore present which is able to influence the fan-type X-ray beam per sector thereof. The beam sector modulation system is controlled by means of regulating signals supplied via a conductor 6.

During operation, the X-ray beam 4 transradiates a body 7 under examination. Placed behind the body 7 is an X-ray detector 8 for recording the X-ray shadow image. The X-ray detector 8 may, for example, be a large format cassette as shown in FIG. 1, but it may also be, for example, a moving elongated X-ray image intensifier.

In order to form an image, on the x-ray detector, of the entire body 7 or at least a part thereof which is under examination such as the thorax, the fan-type X-ray beam executes, during operation, a scanning movement such as is indicated diagrammatically by an arrow 9. For this purpose, the X-ray source together with the slit diaphragm 2 and the system 5 may be arranged pivotably with respect to the X-ray focus f as indicated by an arrow 10. However, it is also possible to scan a body under examination with a flat X-ray beam in a different manner, for example by causing the X-ray source to execute a linear movement together with or without the slit diaphragm.

Placed between the body- 7 and the X-ray detector 8 are detection means 11 which are designed to detect the quantity of radiation transmitted through the body instantaneously per sector of the fan-type beam 4 and to convert it into, corresponding electrical signals which are fed via an electrical connection 12 to a regulating system 13 which forms regulating signals for the modulation system 5 from the input signals. The detection means 11 may comprise, for example, a one-dimensional stationary dosimeter which extends essentially parallel to the X-ray detector or the plane in which the latter executes a scanning movement. The dosimeter has dimensions such that it covers the entire width of the region scanned by the flat X-ray beam during operation and is moved, during operation, synchronously up and down with the X-ray beam as shown by the arrows 14. The dosimeter has been described above as a one-dimensional dosimeter. This term is not mathematically correct, but the thickness of the dosimeter is relatively low when viewed in the direction of the X-ray radiation.

Suitable dosimeters may comprise an ionization chamber divided into sections and are, for example, described in the Applicant's Dutch Patent Applications 85.03152 and 85.03153. It is pointed out that the detection means may also be placed behind the X-ray screen 8, for example in the manner described in the Dutch Patent Application 84.00845. Furthermore, a two-dimensional dosimeter such as that described, for example, in the Applicant's earlier Dutch Patent Application 87.01122 may also be used.

As described in the Dutch Patent Application 84.00845, the beam sector modulation system may comprise a multiplicity of tongues of, for example, piezoelectric material placed next to one another and having one end mounted on a carrier, the other, free end of which can be brought to a greater or lesser degree into the X-ray beam under the influence of the regulating signals. The free ends of the tongues may optionally furthermore be provided with separate absorption devices of a material which absorbs X-ray radiation. Such a tongue-type modulator is shown diagrammatically at 15 in FIG. 1 by way of example, but within the scope of the invention, other types of beam sector modulators can also be used.

As already noted, hysteresis phenomena which have the result that the beam sector modulators assume a position with respect to the X-ray beam other than that corresponding to the regulating signals supplied, may occur in practice in controlling the beam sector modulators.

These hysteresis phenomena may be the result of a mechanical hysteresis such as occurs, for example, in the case of springs or of an electromechanical hysteresis such as occurs in the case of piezoelectric devices or of magnetic hysteresis such as occurs in the case of (electro)magnets.

The influence of the hysteresis phenomena may be eliminated or at least reduced, according to the invention, by using one or more additional detectors which provide signals which precisely correspond to the instantaneous positions of the beam sector modulators.

Figure 2:
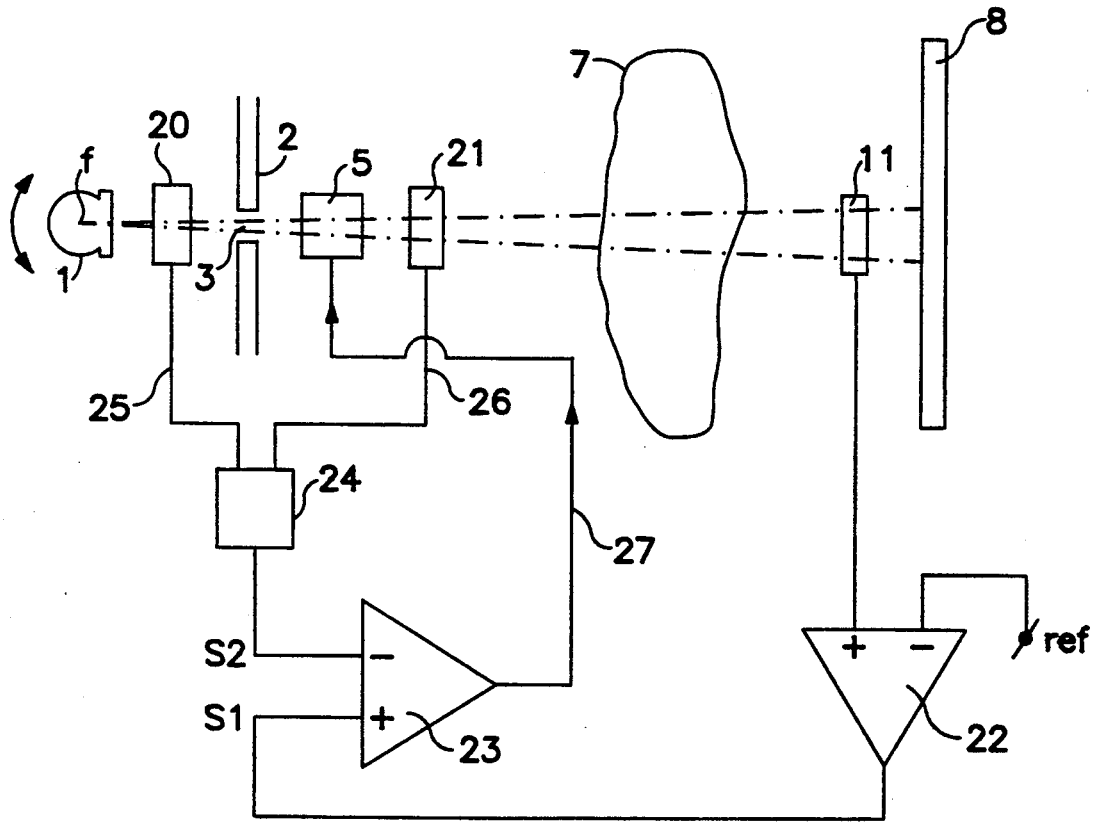
FIG. 2 shows diagrammatically an exemplary embodiment of an apparatus according to the invention.

FIG. 2 shows diagrammatically a first embodiment of an apparatus according to the invention. In FIG. 2, the same reference numerals have been used for corresponding elements as in FIG. 1.

Placed between the X-ray source 1 and the beam sector modulation system 5 is a first additional radiation detector 20 which is able to detect the quantity of radiation provided per sector of the X-ray beam and is able to provide electrical signals corresponding thereto. A suitable radiation detector is, for example, the dosimeter described in the Applicant's Dutch Patent Application 85.03153. The radiation detector 20 is placed, in the example shown, between the X-ray source 1 and the slit diaphragm 2. The operating region of the detector should then correspond to that portion of the X-ray beam which can actually be transmitted through the slit 3 of the slit diaphragm. That can be achieved electronically by processing the signal on the line 25 but screening means may also be used for this purpose. The radiation detector 20 may also be placed between the diaphragm and the beam sector modulation system.

It is possible to provide the beam sector modulation system between the slit diaphragm and the X-ray source. In that case, the radiation detector 20 should be situated between the X-ray source and the beam sector modulator.

A second radiation detector 21 is furthermore provided beyond the beam sector modulation system. The second radiation detector is able to measure the quantity of radiation instantaneously incident on the body under examination per sector of the fan-type X-ray beam 4 and is able to provide corresponding electrical signals.

Therefore, the difference in, or the ratio of, the output signals of the first and second radiation detector is a measure of the actual position of each beam sector modulator for each beam sector.

As a result of then comparing this actual position with the desired position, control signals can be obtained with which the beam sector modulators can be precisely controlled. By starting from the actual position of the beam sector modulators, automatic compensation can be provided for hysteresis effects.

Electrical signals which represent the desired position of the beam sector modulators are provided in a known manner by the detection means 11 which are situated behind the body under examination. The signals originating from the detection means are applied, possibly after comparison with a first reference signal in a differential amplifier 22, as a reference signal $S_1$ to a first input of a differential amplifier 23 which receives, at the other input, a signal $S_2$ representing the actual position of the beam sector modulator of the respective sector.

The signal $S_2$ is the output signal of a device 24 which receives the output signals of the first and second radiation detector via conductors 25 and 26 and is able to compare said signals sector-wise with one another for providing, per sector, a signal $S_2$ which represents the actual position of the beam sector modulator associated with the respective sector. The device 24 may be, for example, a differential amplifier or a divider.

Finally, the output signals $S_3$ of the differential amplifier 23 are used as control signals for the beam sector modulators and are fed via a conductor 27 to the respective beam sector modulators or to the control devices therefor.

The radiation detectors 20 and 21 may move concomitantly with the scanning movement of the X-ray source. As an alternative, the radiation detectors 20 and 21 may be constructed as two-dimensional detectors as already specified above for the detector 11.

It is also possible to construct, for example, the first radiation detector 20 as a concomitantly moving one-dimensional detector and the second detector 21 as a two-dimensional detector as described, for example, in the Applicant's earlier Dutch Patent Application 87.01122.

This and similar modifications are obvious to the person skilled in the art and are considered to fall within the scope of the invention.

According to an alternative elaboration of the inventive idea, instantaneous actual positions of the beam sector modulators may also be detected in a different manner. Although use is preferably made of contactless position-determining methods, it is possible in principle to couple each beam sector modulator mechanically to, for example, the slider of an adjustable resistor or the movable plate of an adjustable capacitor. Use may also be made of diverse known types of displacement meters such as, for example, coaxial capacitive displacement meters with a central electrode which is able to move inside an assembly of cylindrical electrodes in accordance with the movement of a feeler arm. An inductive method of measurement in which each beam sector modulator is coupled to a movable coil core may also be used.

It is also possible to use each beam sector modulator itself as the electrode of a capacitor, or to provide a capacitor electrode in order to determine the instantaneous position of each beam sector modulator in a capacitive manner with the aid of a suitable counterelectrode and a suitable measurement voltage.

FIG. 3 indicates diagrammatically, by way of example, a method in which a tongue-type beam sector modulator 30 forms a movable capacitor electrode which interacts with a fixed capacitor electrode 31. A suitable measurement signal can be applied between the electrodes 30 and 31, for example a high-frequency measuring voltage provided by a measuring voltage source 32. The impedance of the circuit comprising the variable capacitor 30, 31 depends on the position of the electrode 30. This can be measured in a known manner suitable for the purpose with the aid of a suitable detector 33. The detector 33 is designed in a manner such that it delivers a signal $S_2$ which is representative of the instantaneous actual position of the beam sector modulator and which, as in the example of FIG. 2, is fed to a differential amplifier 23. In a practical embodiment, the electrode 31 may be a strip-type common electrode for all the beam sector modulators and the beam sector modulators may be connected consecutively to the measuring signal source 32 by means of an electronic or mechanical scanning system.

FIG. 4 shows diagrammatically, by way of example, a method of determining the instantaneous position of a beam sector modulator optically. The tongue-type beam sector modulators 40 shown in the example are illuminated by a light source 41. Situated at the other side of the beam sector modulators is, for each beam sector modulator, a light detector 42, for example a photosensitive semiconductor device, which, depending on the size of the shadow region 43 due to the beam sector 25 modulator, delivers an electrical signal $S_2$ which is again fed to a differential amplifier 23 in the manner already described above.

It is true both of the embodiment of FIG. 3 and the embodiment of FIG. 4 that the methods shown are suitable for differently formed beam sector modulators with modifications which are obvious to the person skilled in the art. The position of a fixed device coupled to the beam sector modulator may also be determined instead of the position of a beam sector modulator itself.

FIG. 5 shows an inductive method of measurement in which each beam sector modulator is coupled to a movable core 36 of a coil 35.

After the above, this and similar modifications are obvious to the person skilled in the art.

We claim:

1. Method for slit radiography in which, with the aid of an X-ray source and a slit-type diaphragm placed in front of the X-ray source, a fan-type X-ray beam is formed, with which beam a body under examination is scanned at least partially in a direction transverse to the longitudinal direction of the slit of the slit-type diaphragm in order to form an X-ray shadow image on an X-ray detector placed behind the body, which fan-type X-ray beam is formed by a multiplicity of sectors situated adjacently to one another, the transmitted X-ray radiation being influenced instantaneously during the scanning movement per sector of the fan-type beam, while in operation, by means of controllable beam sector modulators interacting with the slit diaphragm, the quantity of radiation transmitted through the body being measured with the aid of detection means instantaneously per sector of the X-ray beam during the scanning movement and the measurement result being used to control the beam sector modulators, characterized in that, during operation, the instantaneous position of each beam sector modulator is continuously detected, in that an electrical signal representing the instantaneous position is generated for each beam sector modulator, in that the electrical signal representing the instantaneous position is compared with the measurement result provided by the detection means and associated with the respective beam sector, and in that a control signal for the respective beam sector modulator is formed from the measurement result and the signal representing the instantaneous position.

2. Method according to claim 1, characterized in that the signal representing the instantaneous position is obtained with the aid of a system of radiation detectors having a first radiation detector which is placed between the X-ray source and the beam sector modulators the beam sector modulators.

3. Method according to claim 1, characterized in that the signal representing the instantaneous position is obtained with the aid of an electrical measuring method in which the movement of each beam sector modulator brings about an impedance change in a measuring circuit, which impedance change is detected and is converted into a signal representing the instantaneous position.

4. Method according to claim 1, characterized in that the signal representing the instantaneous position is obtained with the aid of an optical measurement method in which the movement of each beam sector modulator brings about a change in the light incident on an associated light detector and originating from a light source and in which each light detector provides an electrical signal corresponding to the incident quantity of light

5. Slit radiography apparatus comprising an X-ray source which is able to scan, at least partially, via a slit of a slit diaphragm a body under examination with a fan-type beam in a direction transverse to the longitudinal direction of the slit in order to form an X-ray shadow image on an X-ray detector, beam sector modulators interacting with the slit diaphragm which, during operation, are able to influence the fan-type beam instantaneously per sector during the scanning movement in order to be able to regulate the X-ray radiation incident in each sector on the body under examination, and detection means which are designed to detect, during a scanning movement of the X-ray beam, the quantity of X-ray radiation transmitted through the body instantaneously per sector and to convert it into corresponding signals, which apparatus is characterized by means which, during operation, are able to detect the instantaneous position of each beam sector modulator and are able to provide electrical signals corresponding to the detected positions, and by means which are able to form control signals for the beam sector modulators from the said electrical signals and the signals provided by the detection means for the quantity of radiation transmitted through a body.

6. Apparatus according to claim 5, characterized in that the means for detecting the instantaneous position of the beam sector modulators comprise a first radiation detector placed between the X-ray source and the beam sector modulators and a second radiation detector placed between the beam sector modulators and the body under examination.

7. Apparatus according to claim 6, characterized in that at least one radiation detector consists of an elongated ionization chamber which is divided into sections corresponding to the beam sectors.

8. Apparatus according to claim 5 or 6, characterized in that at least one radiation detector consists of a two-dimensional ionization chamber which is divided into sections corresponding to the beam sectors.

9. Apparatus according to one of claims 6 to 8 inclusively, characterized by a comparison system which compares the signals provided by the first and second radiation detectors per beam sector with one another and provides corresponding output signals, which output signals are fed to a first input of a differential amplifier which receives at the other input signals which represent the quantity of radiation detected in the corresponding sector by the detection means and transmitted by the body under examination, which differential amplifier provides, at the output, control signals for the beam sector modulator associated with the respective sector.

10. Apparatus according to claim 9, characterized in that the comparison system comprises a divider.

11. Apparatus according to claim 9, characterized in that the comparison system comprises a differential amplifier.

12. Apparatus according to claim 5, characterized in that the means for detecting the instantaneous position of the beam sector modulators comprise a measuring circuit for each beam sector modulator, which measuring circuit is provided with a measuring signal source and a variable electrical impedance component, the actuating device of the variable electrical impedance component being mechanically coupled to the respective beam sector modulator in order to transmit the movement of the beam sector modulator.

13. Apparatus according to claim 5, characterized in that the means for detecting the instantaneous position of the beam sector modulators comprise a measuring circuit for each beam sector modulator, which measuring circuit is provided with a measuring signal source and a variable electrical impedance component, the electrical impedance component forming a reactive impedance which can be contactlessly changed.

14. Apparatus according to claim 13, characterized in that the reactive impedance comprises a coil with a core which can be moved relatively with respect to the coil.

15. Apparatus according to claim 13, characterized in that the reactive impedance comprises a capacitor having a movable electrode and a fixed counterelectrode.

16. Apparatus according to claim 15, characterized in that the fixed counterelectrode is a common counter electrode for at least a number of beam sector modulators.

17. Apparatus according to claim 15 or 16, characterized in that each beam sector modulator itself embodies a movable electrode.

18. Apparatus according to claim 5, characterized in that the means for detecting the instantaneous position of the beam sector modulators comprise illumination means for each beam sector modulator or a light-intercepting device coupled thereto and also light detection means which are able to detect by means of the size of the shadow cast by each beam sector modulator and to convert the magnitude into an electrical signal.

* * * * *